US005363577A

United States Patent [19]

Fuller et al.

[11] Patent Number: 5,363,577

[45] Date of Patent: Nov. 15, 1994

[54] ALPHANUMERIC AND GRAPHIC WATER DISPLAY

[76] Inventors: Mark Fuller, 10711 Bluffside Dr., #101, Studio City, Calif. 91604; Alan Robinson, 5344 C N. Peck Rd., El Monte, Calif. 91732

[21] Appl. No.: 94,583

[22] Filed: Jul. 19, 1993

Related U.S. Application Data

[63] Continuation of Ser. No. 755,644, Sep. 6, 1991, abandoned.

[51] Int. Cl.[5] ..... G09F 13/24

[52] U.S. Cl. ..... 40/406; 40/439

[58] Field of Search ..... 40/406, 477, 439

[56] References Cited

U.S. PATENT DOCUMENTS 3,973,340 8/1976 Khawand ..... 40/406

4,892,250 1/1990 Fuller et al. ..... 40/406

*Primary Examiner*—Kenneth J. Dorner

*Assistant Examiner*—C. Hope Davis

*Attorney, Agent, or Firm*—Blakely, Sokoloff, Taylor & Zafman

[57] ABSTRACT

A liquid display that has a plurality of adjacent parallel tubes filled with a fluid and connected to a source of air that introduces bubbles into the tubes, so that the combination of bubbles form a word, or another recognizable graphic display. Each tube has a valve connected to the air supply, that controls the duration and flowrate of air injected into the tube so that a single bubble is formed within the tube. The valves are connected to a computer that opens and closes each valve to produce a pattern of bubbles in accordance with a computer program within the computer. The program creates a combination of bubbles that together depict a legible design or display.

28 Claims, 2 Drawing Sheets

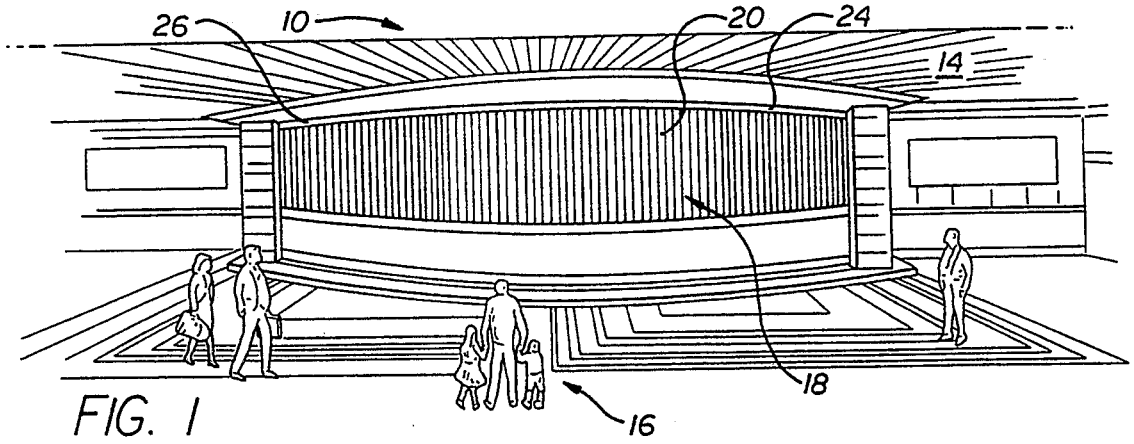
FIG. 1
FIG. 2
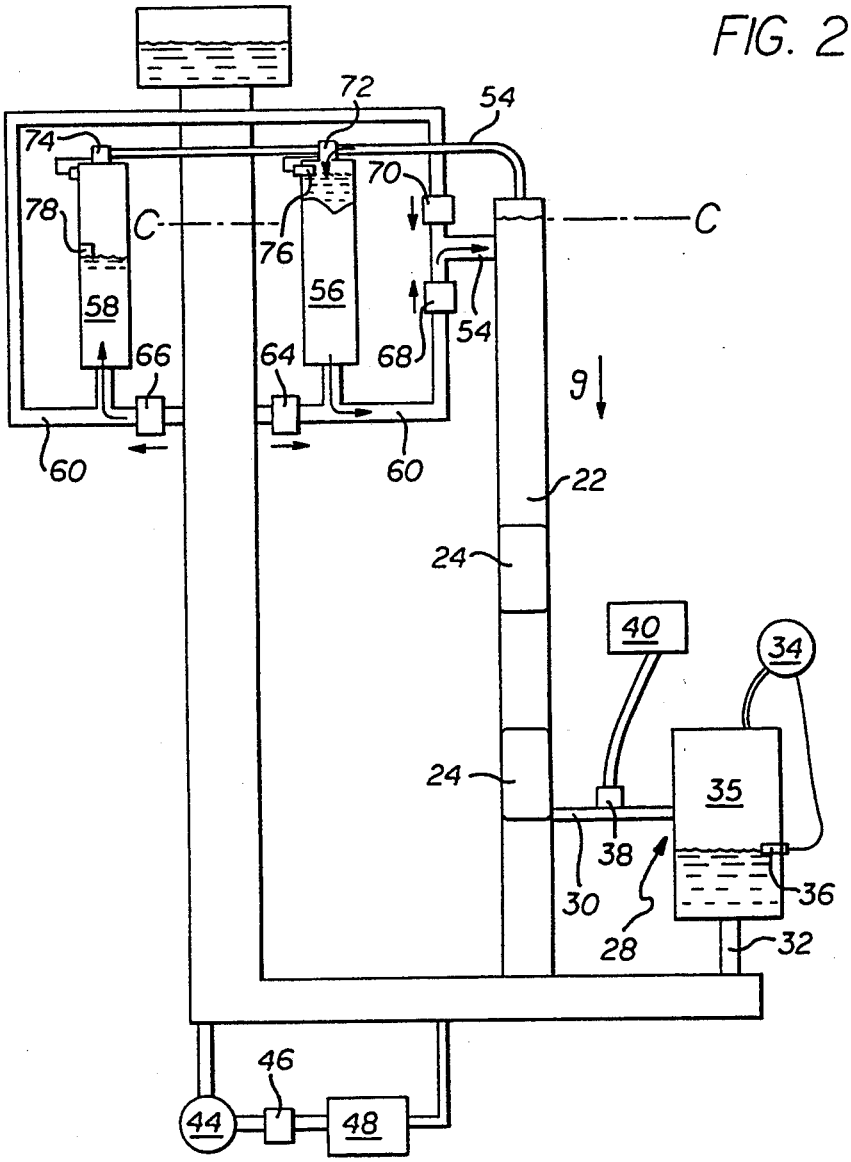

ALPHANUMERIC AND GRAPHIC WATER DISPLAY

This is a continuation of application Ser. No. 07/755,644 filed Sep. 6, 1991, now abandoned.

FIELD OF THE INVENTION

The present invention relates to a water display that can display graphic symbols such as letters and words.

DESCRIPTION OF RELATED ART

Electronic billboards are a popular means of communicating information to viewers. Such displays typically show a message or a series of messages. The utilization of such billboards range from a bank sign that provides the time and temperature, to a scoreboard at an athletic arena. While electronic displays are sufficient to relay the desired information, the displays are mechanical in appearance and do not provide an alternate aesthetic feature.

Liquid displays such as "lava lamps" provide viewers with a source of amusement, wherein one can watch different patterns of bubbles floating up a fluid filled tube. The size and occurrence of the bubbles is usually quite random, producing an arrangement of bubbles that is incoherent to the typical human mind. It would be desirable to provide a liquid display that creates a plurality of bubbles that combine to form a visual image, such as a word or a company logo.

SUMMARY OF THE INVENTION

The present invention is a liquid display that has a plurality of adjacent parallel tubes filled with a fluid and connected to a source of air that introduces bubbles into the tubes. Each tube has a valve that controls the duration and flowrate of air injected into the tube, so that a single homogeneous bubble is formed. The flowrate and pressure are also such that the introduction of a bubble in a tube, will not disturb the movement of a bubble that is already floating up the tube. The valves are connected to a computer that opens and closes the valves of each tube, to produce a pattern of bubbles in accordance with a computer program within the computer. The program creates a combination of bubbles that together depict a legible design or display. In the preferred embodiment, the fluid is colored and the tubes are placed next to a wall so that the bubbles are distinguishable to the human eye.

The display may also have an accumulator that vents off the air bubbles and resupplies the tubes with fluid. The accumulator is constructed so that the flow of air and fluid occurs without any sudden change of pressure in the system. A sudden pressure change would cause the bubbles to move or jump, which would decrease the predictability and quality of the display.

Therefore it is an object of this invention to provide a liquid display that creates air bubbles which depict legible graphic displays.

It is also an object of this invention to provide a liquid display that can create a series of bubbles that float up a tube, without having a sudden movement of any preceding bubbles.

BRIEF DESCRIPTION OF THE DRAWINGS

The objects and advantages of the present invention will become more readily apparent to those skilled in the art after reviewing the following detailed description and accompanying drawings, wherein:

FIG. 1 is a perspective view of a liquid display of the present invention mounted onto the wall of a building;

FIG. 2 is a schematic of a single tube with a valve that controls the flow of air from a pressurized tank;

DETAILED DESCRIPTION OF THE INVENTION

Figure 3:
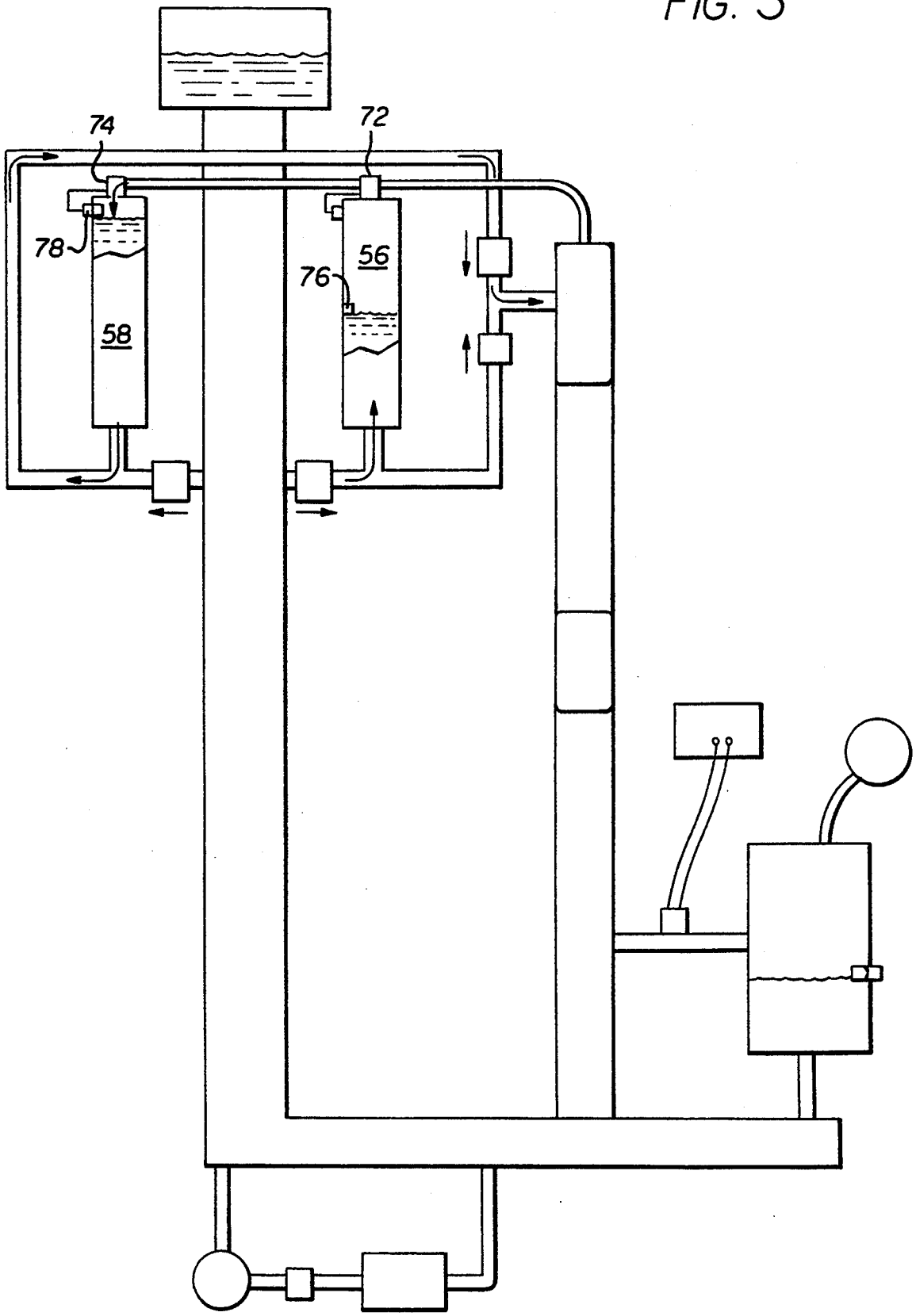
FIG. 3 is a schematic of the tube of FIG. 2, showing the tube being switched from a first take-up tank to a second take-up tank.

Referring to the drawings more particularly by reference numbers, FIG. 1 shows a liquid display 10 of the present invention. The display is preferably mounted to the wall 12 of a building structure 14 so that viewers 16 can easily see the graphic pattern 18 depicted by the display. As shown, the display 10 can be rather large and constructed to have a curvature, so that the of viewers 16 can see the pattern from different angles. Although a room size liquid display is shown, it is to be understood that a smaller version of the invention can be constructed. The display 10 has a plurality of adjacent fluid 20 filled tubes 22. Bubbles 24 are introduced into the tubes, so that the bubbles 24 combine to form a picture or a word as shown in FIG. 1. The bubbles 24 are typically air which rises to the top of the tube 22. For For this reason the graphic pattern tends to rotate from the bottom to the top of the display 10. The display 10 could relay messages such as news information or the time of day, or the bubbles could form a company logo or another form of advertising. The fluid 20 is typically water which is preferably colored black, so that the bubbles 24 are clearly distinguishable from the fluid 20. The tubes 22 can be placed next to a wall 26 that is white or another color, to further contrast the bubbles 24 from the fluid 20. As another embodiment, the wall 26 can be illuminated with a color that is complementary to the fluid 20. For instance, the wall 26 could emit red light and the fluid 20 can be dyed blue, so that the fluid appears black and the bubbles transmit the red light.

FIG. 2 shows a single tube 22 of the present invention, The tube 22 is long and narrow and is filled with a fluid 20 along the longitudinal axis, Gravity pulls in the direction indicated by the arrow. The tube 22 is connected to an air tank 28 by an air line 30 and a fluid line 32. The air tank 28 is connected to a compressor 34, or another means of providing pressurized air 35 to the tank 28. In the preferred embodiment, the compressor 34 is an eductor which draws in air from the movement of fluid. The fluid stream is created by an hydraulic pump (not shown). The eductor is attached to a separator (not shown), which allows the air to separate from the fluid so that the air can be drawn by the tank 28. The eductor and separator provide a source of pressurized air that is not contaminated by oils, etc., typically associated with mechanical compressors. The oil could settle at the interface of the fluid and bubbles thereby distorting the display.

The tank 28 has a float valve 36 that allows air to enter the tank only when the fluid 20 is below a predetermined level. The predetermined level of the float valve 36 is lower than the fluid level at the inlet of the air line 30, so that the pressure of the air 35 in the tank 28 is always higher than the hydrostatic pressure of the fluid 20 at the point where the air 35 is introduced into the tube 22. The higher air pressure insures that there is a positive flow from the tank 28 into the tube 22. The pressure differential between the air 35 and fluid 20 is low enough, so that the introduction of air 35 into the tube 22 does not cause a sudden movement in any bubbles already floating up the tube 22. It has been found that a pressure differential of approximately 2 inches of water creates a bubble 24 that will not cause a disturbance in the tube 22.

Within the air line 30 is a valve 38 that controls the flow of air from the tank 28 to the tube 22. The valve 38 is connected to a controller 40 that provides a voltage to open the valve 38 for a predetermined amount of time. The valve 38 can also provide flow control, so that air flows into the tube 22 at a rate which creates a single homogeneous bubble 24 without disturbing any bubbles 24 that already exist in the tube 22. The controller 40 may be a computer with a computer program that opens and closes the valve 38 in accordance with the operating instructions of the program. Each tube 22 has a valve 38 that is controlled by the computer 40, which opens the valves 38 and produces bubbles 24, so that the location of the bubbles 24 within each tube 22 are coordinated to create a predetermined pattern.

The tubes 22 are connected to a reservoir 42 of fluid 20 that also allows communication between each tube 22, and between the tubes 22 and the air tank 28. The reservoir 42 and tubes 22 are connected to a pump 44 that pumps the fluid 20 through a filter 46 and heat exchanger 48 that clean and cool the fluid 20. The heat exchanger 48 is of such a capacity that the fluid 20 is kept at an essentially constant temperature, so that the fluid 20 has a constant viscosity. Having a consistent fluid viscosity produces a repeatable system, wherein the formation of the bubbles is predictable throughout the operation of the display. If the temperature of the fluid 20 were to change, then the size of each bubble 24 would also change accordingly. The reservoir 42 also has a head tank 90 with an air chamber 92 that is connected to the compressor 34. The compressor 34 draws air from the air chamber 92, which collects the air of the bubbles 24. The connection of the compressor 34 to the head tank 90 creates a closed system that prevents the air from becoming contaminated.

As previously discussed the pressure of the air 35 in the tank 28 is slightly greater than the pressure of the fluid 20 at the air inlet 30. Because of this differential pressure, it is believed that the introduction of air 35 pushes the fluid 20 down the tube 22 and into the reservoir 42. As more air 35 is released into the tube 22, more fluid 20 is displaced from the tube 22. When the bubble 24 rises to the top, the bubble 24 must be released, wherein the tube 22 is once again filled with fluid 20. To release the air and to refill the tube 22 with fluid 20, an accumulator 50 can be connected to the top of the tube 22.

FIG. 2 shows a preferred embodiment of the accumulator 50. The accumulator 50 has an inlet tube 52 generally located below the water level of the tube. The tube 22 is completely filled with fluid 20, wherein the pressure of the fluid at line c of the tube 22 is the same pressure as the pressure of the fluid in the reservoir 42 at the same level. An air line 54 extends from a first 56 and a second 58 take-up tank to the top of the tube 22. The air line 54 allows the bubbles 24 to bleed out of the tube 22. The take-up tanks are connected to the reservoir 42 by fluid lines 60. In the fluid lines 60 are four check valves 64, 66, 68 and 70, that allow fluid 20 to flow only in the directions indicated by the arrows next to the valves in FIG. 2. The tanks are also connected to the head tank 90. Each take-up tank has a three-way valve, 72 and 74, that regulates the flow of air between the tube 22 and tanks, and between the tanks and the air chamber 92 of the head tank. The valves are preferably solenoid valves that are attached to a timer 76 that can energize and open each valve, such that the tanks are in communication with either the air line 54 or the head tank 90. The valves are 180 degrees out of phase with each other, so that when one tank is in communication with the air tube 54, the other tank is exposed to the air chamber 92. There is typically one timer 76 connected to the tanks of each tube 22. The timer 76 is set so that the valves are switched, only when the tank in communication with the reservoir is completely filled with fluid. In the preferred embodiment, the switching time is greater than the time it takes to completely fill a tank. By switching only when the tank is full, the system insures that there is no air in the tank, so that there is not a sudden change in pressure when the tube is switched into fluid communication with the filled tank.

To more easily describe the operation of the accumulator 50, an initial state will include having the first tank 56 full of fluid and in communication with the tube 54, and the second tank 58 partially full of fluid and exposed to the air chamber 92 as shown in FIG. 2. When a bubble 24 rises to the top of the tube 22, the valve 72 in the first tank 56 allows the pressurized air in the tube 22 to flow into the first tank 56, while fluid 20 in the first tank 56 flows into the tube 22. In the meantime, the second tank 58 is being filled with fluid 20 from the reservoir 42, which has a higher pressure than the tank 58.

When the tank 58 is completely filled, the valve 74 receives an input signal from the timer 76, which switches the valve 74 so that the tank 58 is in communication with the tube 22. The timer 76 also switches the valve 72 simultaneously with the second valve 74, so that the first tank 56 is exposed to the head tank 90 which allows the pressurized air in the tank 56 to flow into the air chamber. As shown in FIG. 3, while the air is bleeding from the first tank 56, the bubbles float into the second tank 58 while fluid 20 flows from the tank 58 to the tube 22. The accumulator 50 is preferably constructed as shown in FIGS. 2 and 3, wherein the fluid 20 flows from tank 58 along the top fluid line 60. The constant switching of the valves insures that air is always being bled from the tube 22 into the head tank 90. Switching the tanks only when the inactive tank is completely filled, allows the air to be released without suddenly creating a sudden pressure change in the system. This insures that the bubbles 24 will rise in a smooth orderly fashion, so that there is not a sudden jump or rise in the bubbles 24 as they float up the tube 22. The check valves 68 and 70 prevent air from entering the tanks through the fluid lines. Check valves 64 and 66 allow the take-up tanks to be filed by the reservoir 42 while preventing water from flowing to the reservoir 42, when the tanks are resupplying the tube 22.

The display 10 is preferably constructed so that there are a plurality of adjacent tubes 22, with the longitudinal axis of the tubes being essentially parallel. Each tube 22 preferably has a separate accumulator 50 and an air valve 38. The air valves 38 of each tube are all connected to a central controller 40. The controller 40 is typically a computer with a plurality of output terminals, wherein each air valve 38 is coupled to a pair of terminals. The controller 40 has a program that opens a predetermined number of air valves for a predetermined amount of time, so that the bubbles 24 created in each tube 22 combine to form a visual display. The controller 40 may be connected to an outside wire source and have a program to directly convert information to a visual display of bubbles, wherein real time news or other information may be relayed by the water display 10.

In the preferred embodiment, the controller 40 is connected to a computer 80, that is attached to a document scanner 82. The document scanner 82 will scan a piece of paper and relay a bit map to the computer 80. The bit map is an array of digital signals that identify whether a given location of the paper (pixel) is white or dark. The computer 80 has memory means that stores the bit map. Computers 80 and scanners 82 that create and store such a bit map are known and commercially available. The computer 80 has a computer program that provides operating instructions that sends data to the controller 40. The controller 40 opens the various valves 38 depending upon the content of the data. The computer 80 typically sends data to the controller 40 corresponding to a single line on the document that was scanned. That is the data is sent line by line. Because there is usually less tubes than the number of scanned data points in a line, the computer program will output a data stream to the controller 40 that will correspond to the number of air valves 38. For example, if the scanner creates 64 data points for each line and there are 8 tubes, the computer 80 will output to the controller 8 signals corresponding to every fourth data point. That is the controller will receive a digital signal that represents the color of the 1, 4, 8 . . . pixels across a line of the document. As the number of tubes are increased, so is the resolution of the display. The computer 80 delays sending the next line of data until the bubbles 24 have fully developed, such that each row of developed bubbles represents a line on the scanned document.

The data sent by the computer 80 is typically sent through a serial port to the controller 40, which may have a number of shift registers to store the data until a complete line of data is received. The computer 80 preferably sends the data in byte format. Once the controller 40 receives all the data for a line, the registers are latched to send the data to each corresponding valve. For instance, a low voltage data signal (0) may correspond to a dark pixel on the scanned document. The low voltage signal is then sent to the controller 40 which for example may store the data in the first shift register. When the register is latched, the controller opens up the air valve connected to the first shift register, which creates a bubble corresponding to the dark spot on the scanned document.

The computer 80 sends the data line by line as the valves 38 and tubes 22 create a display simulating the print on the scanned document. This embodiment would allow the rapid display of a message provided by any bystander in a shopping mall or other public building.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A liquid display, comprising:

at least one fluid filled tube that has a longitudinal axis;

air means operatively connected to said tube for introducing air into said tube;

first valve means operatively connected to said tube and said air means for introducing air into said tube such that said air forms a bubble in said tube;

control means operatively connected to said valve means for controlling said bubble size and frequency of occurrence; and, accumulator means for receiving and supplying fluid to said tube in response to said introduction of said air into said tube and for bleeding said air from said tube into an ambient without exposing said tube to the ambient;

whereby there is a pattern of bubbles created within said tube that float up said longitudinal axis of said tube.

2. The liquid display as recited in claim 1, wherein said air means includes an air tank in fluid communication with said tube such that said fluid can flow from said tube into said air tank, said air tank having sensor means operatively connected to a compressor for supplying pressurized air from said compressor to said air tank when said fluid reaches a predetermined level within said air tank.

3. The liquid display as recited in claim 2, further comprising a fluid reservoir connected to said tube.

4. The liquid display as recited in claim 3, wherein said tube and said reservoir are operatively connected to a pump that pumps said fluid through a filter and a heat exchanger to clean and keep said fluid temperature constant, respectively.

5. The liquid display as recited in claim 3, wherein said accumulator means is operatively connected to said tube, said reservoir and said compressor, said accumulator allows said air to flow from said tube to said compressor while allowing said fluid to flow from said reservoir to said tube, said air being recirculated through said air means and said tube in a closed system.

6. The liquid display as recited in claim 5, wherein said accumulator includes first and second tanks operatively connected to said tube and to an air chamber in communication with said compressor, said tanks contain fluid and have second valve means connected to an air line that switches said tanks between a condition wherein said tanks are in fluid communication with said tube or a condition wherein said tanks are exposed to said air chamber, said tanks being out of phase such that when said first tank is in fluid communication with said tube said second tank is in communication with said air chamber, said tanks being constructed such that said air can flow through said air line from said tube into said tank and said fluid can flow through fluid lines from said tank into said tube when said tanks are in fluid communication with said tube, said tanks further being connected to said reservoir such that said fluid can flow from said reservoir to said tanks and said air within said tanks can flow to said air chamber when said tanks are in communication with said air chamber.

7. The liquid display as recited in claim 6, wherein said second valve means are connected to a timer that switches said second valve means when one of said tanks is completely filled with said fluid.

8. The liquid display as recited in claim 7, wherein said accumulator has a plurality of check valves that allow said fluid to flow only from said reservoir to said tanks and from said tanks to said tube.

9. The liquid display as recited in claim 1, wherein said air is introduced into said tube at a predetermined location and said air has a pressure that is greater than a pressure of said liquid at said predetermined location by approximately 2 inches of water.

10. The liquid display as recited in claim 1, further comprising a source of light adjacent to said tube such that light is directed toward said tube, said fluid having a predetermined color such that said light of said light source is only transmitted through said bubble.

11. A liquid display, comprising:

a plurality of adjacent fluid filled tubes that each have a longitudinal axis;

air means operatively connected to said tubes for introducing air into said tubes;

a plurality of air valves operatively connected to said tubes and said air means, each said tube having one said air valve that introduces air into said tube such that said air forms a bubble in said tube;

control means operatively connected to said air valves for controlling said bubble size and frequency of occurrence; and, accumulator means for receiving and supplying fluid in said tube in response to said introduction of said air into said tube and for bleeding said air from said tube into an ambient without exposing said tube to the ambient;

whereby there is a pattern of bubbles created in said tubes that float up said longitudinal axis of said tubes.

12. The liquid display as recited in claim 11, wherein said control means includes a computer with a computer program, connected to a controller to produce a predetermined pattern of bubbles that combine to create a visual display.

13. The liquid display as recited in claim 12, wherein said computer is connected to a scanner adapted to scan a document, wherein said scanner, said computer and said controller can display a visual image of bubbles corresponding to the document.

14. The liquid display as recited in claim 11, wherein said air means includes an air tank in fluid communication with said tubes such that said fluid can flow from said tubes into said air tank, said air tank having sensor means operatively connected to a compressor for supplying pressurized air from said compressor to said air tank when said fluid reaches a predetermined level within said air tank.

15. The liquid display as recited in claim 14, further comprising an accumulator operatively connected to said tubes, said reservoir and said compressor, said accumulator allows said air to flow from said tubes to said compressor while allowing said fluid to flow from said reservoir to said tubes, said air being recirculated through said air means and said tube in a closed system.

16. The liquid display as recited in claim 15, wherein said accumulator comprises having each said tube connected to a pair of tanks by a fluid line and an air line said tanks being operatively connected to an air chamber in communication with said compressor, said tanks contain fluid and have valve means connected to said air line that switches said tank between a condition wherein said tanks are in fluid communication with said tube or a condition wherein said tanks are exposed to said air chamber, said tanks being out of phase such that when one tank is in fluid communication with said tube said other tank is in communication with to said air chamber, said tanks being constructed such that said air can flow through said air line from said tube into said tank and said fluid can flow through said fluid line from said tank into said tube when said tanks are in fluid communication with said tube, said tanks further being connected to said reservoir such that said fluid can flow from said reservoir to said tanks and said air within said tanks can flow to said compressor when said tanks are in communication with said compressor.

17. The liquid display as recited in claim 16, wherein said valve means are connected to a timer that switches said valve means when on of said tanks is completely filled with said fluid.

18. The liquid display as recited in claim 17, wherein said accumulator has a plurality of check valves that allow said fluid to flow only from said reservoir to said tanks and from said tanks to said tube.

19. The liquid display as recited in claim 14, wherein said air is introduced into said tube at a predetermined location and said air has a pressure that is greater than a pressure of said liquid at said predetermined location by approximately 2 inches of water.

20. The liquid display as recited in claim 11, further comprising a fluid reservoir connected to said tubes.

21. The liquid display as recited in claim 20, wherein said tubes and said reservoir are operatively connected to a pump that pumps said fluid through a filter and a heat exchanger to clean and keep said fluid temperature constant, respectively.

22. The liquid display as recited in claim 11, further comprising a source of light adjacent to said tube such that light is directed toward said tube, said fluid having a predetermined color such that said light of said light source is only transmitted through said bubble.

23. A liquid display, comprising:

a plurality of adjacent water filled tubes that are transparent and have a longitudinal axis;

a fluid reservoir operatively connected to said tubes, said reservoir having an air chamber;

an air tank operatively connected to said tubes to introduce air into said tubes, said air tank being in fluid communication with said tubes such that said fluid can flow from said tubes into said air tank, said air tank having sensor means operatively connected to a compressor for supplying pressurized air from said compressor to said air tank when said fluid reaches a predetermined level within said air tank;

a plurality of air valves operatively connected to said tubes and said air tank, each said tube having one said air valve that introduces air into said tube such that said air forms a bubble in said tube;

a plurality of first and second tanks operatively connected to said tubes and to said air chamber, each tube having a pair of said tanks that each contain fluid and have valve means connected to an air line that switches each said tank between a condition wherein said tank is in fluid communication with said tube, or a condition wherein said tank is in communication with said air chamber, said tanks of each said tube being out of phase such that when said first tank is in fluid communication with said tube said second tank is in communication with said air chamber, said tanks being constructed such that said air can flow through said air line from said tube into said tanks and said fluid can flow through fluid line from said tanks into said tube when said tanks are in fluid communication with said tube, said tanks further being connected to said reservoir such that said fluid can flow from said reservoir to said tanks and said air within said tanks can flow to said air chamber when said tanks are in communication with said air chamber;

a timer operatively connected to said valve means for switching said valve means when one of said tanks is filled with said fluid; and, control means operatively connected to said air valves for controlling said bubble size and frequency of occurrence;

whereby there is a pattern of bubbles created within said tubes that float up said longitudinal axis of said tubes.

24. The liquid display as recited in claim 23, wherein said control means includes a computer with a computer program, connected to a controller that produce a predetermined pattern of bubbles that combine to create a visual display.

25. The liquid display as recited in claim 24, wherein said tubes and said reservoir are operatively connected to a pump that pumps said fluid through a filter and a heat exchanger.

26. The liquid display as recited in claim 25, wherein said accumulator has a plurality of check valves that allow said fluid to flow only from said reservoir to said tanks and from said tanks to said tube.

27. The liquid display as recited in claim 26, wherein said air is introduced into said tube at a predetermined location and said air has a pressure that is greater than a pressure of said liquid at said predetermined location by approximately 2 inches of water.

28. The liquid display as recited in claim 27, further comprising a source of light adjacent to said tube such that light is directed toward said tube, said fluid having a predetermined color such that said light of said light source is only transmitted through said bubble.

* * * * *